US011370220B2

(12) United States Patent
Shibasaki et al.

(10) Patent No.: US 11,370,220 B2
(45) Date of Patent: Jun. 28, 2022

(54) LIQUID DISCHARGE APPARATUS

(71) Applicants: Hidehisa Shibasaki, Ibaraki (JP); Naohiro Toda, Kanagawa (JP); Masaya Hamaguchi, Kanagawa (JP)

(72) Inventors: Hidehisa Shibasaki, Ibaraki (JP); Naohiro Toda, Kanagawa (JP); Masaya Hamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 16 days.

(21) Appl. No.: 17/179,372

(22) Filed: Feb. 18, 2021

(65) Prior Publication Data

US 2021/0291531 A1 Sep. 23, 2021

(30) Foreign Application Priority Data

Mar. 23, 2020 (JP) ..... JP2020-051405

(51) Int. Cl.
*B41J 2/165* (2006.01)
*B41J 25/00* (2006.01)

(52) U.S. Cl.
CPC ..... *B41J 2/16523* (2013.01); *B41J 2/16505* (2013.01); *B41J 2/16585* (2013.01); *B41J 2002/16564* (2013.01); *B41J 2025/008* (2013.01)

(58) Field of Classification Search
CPC ..... B41J 2/16523; B41J 2/16505; B41J 2/16585; B41J 2002/16564; B41J 2025/008; B41J 2/16508; B41J 2/16526
See application file for complete search history.

(56) References Cited

U.S. PATENT DOCUMENTS

2017/0266974 A1 9/2017 Hamaguchi et al.

FOREIGN PATENT DOCUMENTS

| | | | |
|---|---|---|---|
| JP | 6-021939 | 3/1994 | |
| JP | H06340092 | * 12/1994 | ..... B41J 2/165 |
| JP | 2006-168093 | 6/2006 | |
| JP | 2007-175969 | 7/2007 | |
| JP | 2008-178998 | 8/2008 | |
| JP | 2015-131435 | 7/2015 | |
| JP | 2017-170876 | 9/2017 | |

* cited by examiner

*Primary Examiner* — Geoffrey S Mruk
(74) *Attorney, Agent, or Firm* — Duft & Bornsen, PC

(57) ABSTRACT

A liquid discharge apparatus includes a liquid discharge head including a nozzle face including a nozzle configured to discharge a liquid, a head cap configured to cover the nozzle face of the liquid discharge head, a buffer tank disposed downstream from the head cap in a direction of collection of the liquid from the liquid discharge head and configured to temporarily store the liquid, a communication passage coupling the head cap and the buffer tank, and a heater configured to heat the liquid stored in the buffer tank. The quid discharge apparatus further includes a heat source configured to generate heat and a heat introduction passage coupling the heat source with the buffer tank, to introduce exhaust heat from the heat source into the buffer tank.

10 Claims, 8 Drawing Sheets

LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-051405, filed on Mar. 23, 2020, in the Japan Patent Office, the entire disclosure of which is hereby incorporated by reference herein.

BACKGROUND

Technical Field

Aspects of the present disclosure relate to a liquid discharge apparatus.

Related Art

Liquid discharge apparatuses include a liquid discharge head that discharges a liquid from nozzles as droplets. There are liquid discharge apparatuses that include a nozzle maintenance device that performs maintenance of the nozzles for maintaining the discharging performance. There are various types of nozzle maintenance devices.

One type of such a nozzle maintenance device performs a discharge operation to remove liquid in the vicinity of the nozzle (hereinafter also referred to as "purging"). Purging is performed in a state in which a head cap is coupled with a waste liquid tank via piping and the head cap is attached to the liquid discharge head. The head cap is a protective member that can be brought into tight contact with the liquid discharge head so as to cover the side of the liquid discharge head on which nozzles are formed (a nozzle face).

When the liquid discharge head does not operate but is on standby, for example, the head cap is put on the nozzle face of the liquid discharge head, and a passage between the nozzle face (and the vicinity of the nozzle face) and a liquid tank is closed, to prevent drying of the nozzle face. Then, moisture can be retained in the vicinity of the nozzle including the nozzle face, and the passage, and the liquid can be prevented from solidifying.

When the liquid discharge head is covered with the head cap, the liquid adheres to the contact portion (nip surface) of the head cap. When the liquid adhering to the nip surface dries, the degree of contact between the nozzle face and the nip surface decreases, which adversely affects the prevention of drying of the nozzle face and the recovery of discharging performance in purging. Decreases in contact between the nozzle face and the head cap may cause another concern. The liquid solidifies and causes clogging of the piping that couples the head cap with the liquid tank, hindering collection of the waste liquid in the purging.

For example, vapor arising from waste liquid collected in a tank is used to prevent drying of the nozzle face.

SUMMARY

According to an embodiment of this disclosure, a liquid discharge apparatus includes a liquid discharge head including a nozzle face including a nozzle configured to discharge a liquid, a head cap configured to cover the nozzle face of the liquid discharge head, a buffer tank disposed downstream from the head cap in a direction of collection of the liquid from the liquid discharge head and configured to temporarily store the liquid, a communication passage coupling the head cap and the buffer tank, and a heater configured to heat the liquid stored in the buffer tank. The quid discharge apparatus further includes a heat source configured to generate heat and a heat introduction passage coupling the heat source with the buffer tank, to introduce exhaust heat from the heat source into the buffer tank.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
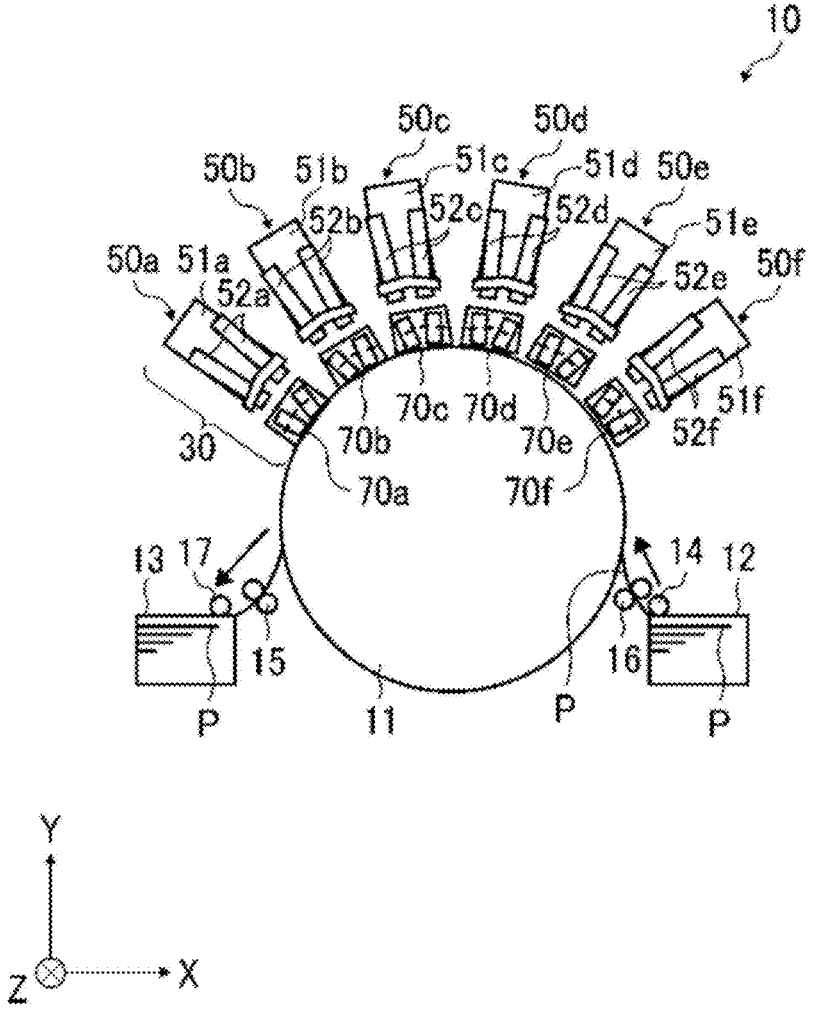
FIG. 1 is a side view illustrating a liquid discharge apparatus common to embodiments of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result. As used herein, the singular forms "a," "an," and "the" are intended to include the plural forms as well, unless the context clearly indicates otherwise.

Hereinafter, embodiments of the present disclosure are described with reference to the drawings. FIG. 1 is a side view illustrating a general arrangement of an inkjet printer 10 as a liquid discharge apparatus according to an embodiment of the present disclosure.

The inkjet printer 10 illustrated in FIG. 1 is an apparatus that applies liquid droplets discharged from liquid discharge heads 52 onto a sheet P (a recording medium) as a target of liquid application. The inkjet printer 10 a liquid discharge apparatus and is an example of an image forming apparatus that discharges, for example, liquid ink from the liquid discharge head 52 to form an image on the sheet P such as paper.

As illustrated in FIG. 1, the inkjet printer 10 includes a conveyor drum 11, a sheet feeding tray 12, an output tray 13, and a liquid discharge assembly 30. The conveyor drum 11 conveys the sheet P held on a circumferential surface of the conveyor drum 11 when liquid is applied thereto. The sheet feeding tray 12 supplies the sheets P stacked therein to the conveyor drum 11. The output tray 13 receives and stacks thereon the sheets P onto which the liquid is applied while the sheet P is conveyed on the circumferential surface of the conveyor drum 11. The liquid discharge assembly 30 discharges the liquid onto the sheet P held on the circumferential surface of the conveyor drum 11.

The conveyor drum 11 conveys the sheet P sent, for example, from the sheet feeding tray 12 in the circumferential direction (in a shape of arc) of the drum. A plurality of small through-holes is in the circumferential surface of the conveyor drum 11 and penetrates a negative pressure space inside the conveyor drum 11. The conveyor drum 61 is provided with a negative pressure generating pump to maintain a negative pressure in the negative pressure space. Accordingly, the sheet P is attracted to the circumferential surface of the conveyor drum 61 in tight contact. The sheet P is, for example, a sheet of paper. The conveyor drum 11 rotates while attracting the sheet P in tight contact with the circumferential surface thereof. At this time, the liquid discharge heads 52 discharge the liquid, to coincide with timing of the movement of the sheet P to the position facing the liquid discharge assembly 30.

The sheets P stacked on the sheet feeding tray 12 are separated by a separation roller 14 and a sheet feeding roller 16 and conveyed one by one to a an upper half area of the circumferential surface (a conveyance portion) of the conveyor drum 11 between a sheet feeding position and a sheet ejection position. As the sheet P to which the liquid has been applied is conveyed to the sheet ejection position on the circumferential surface of the conveyor drum 11, an output roller pair 15 and a forwarding roller 17 separate the sheet P from the conveyor drum 11 and stack the sheet P on the output tray 13.

As illustrated in FIG. 1, the liquid discharge assembly 30 includes six head arrays 50*a*, 50*b*, 50*c*, 50*d*, 50*e*, and 50*f* (also collectively "head arrays 50") that are disposed radially around the upper side (the conveyance portion) of the circumferential surface of the conveyor drum 11. The liquid discharge assembly further includes head caps 70*a*, 70*b*, 70*c*, 70*d*, 70*e*, and 70*f* (also collectively "head caps 70") corresponding to the head arrays 50. Each head cap 70 is disposed between the circumferential surface of the conveyor drum 11 and the corresponding head array 50.

As illustrated in FIG. 1, each head array 50 includes a head array body 51*a*, 51*b*, 51*c*, 51*d*, 51*e*, or 51*f* (collectively "head array body 51") and a plurality of liquid discharge heads 52*a*, 52*b*, 52*c*, 52*d*, 52*e*, or 52*f* (collectively "liquid discharge heads 52") held by the head array body 51. The longitudinal direction (the Z axis direction in the drawing) of each head array body 51 matches the axial direction of the conveyor drum 11. Longitudinal ends of each head array body 51 match longitudinal ends of the conveyor drum 11. The head array body 51 further includes a discharge mechanism to discharge the liquid from the liquid discharge heads 52. The discharge mechanism includes, for example, at least one of a head tank to contain the liquid to be discharged from the liquid discharge heads 52, a carriage, a supply mechanism, a maintenance unit, and a main-scan moving unit.

Figure 2:
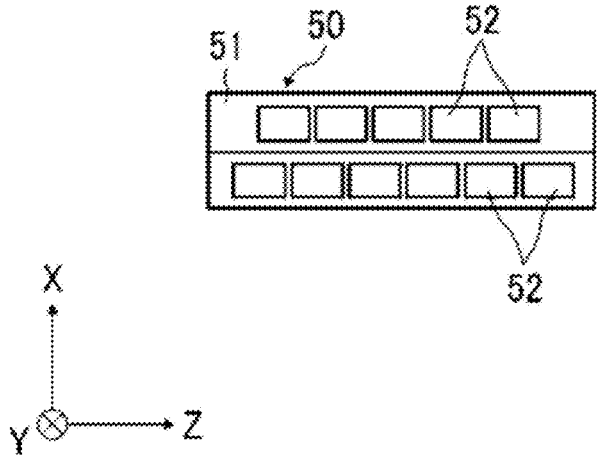
FIG. 2 is a view illustrating a configuration of a liquid discharge head of the liquid discharge apparatus illustrated in FIG. 1.

The liquid discharge head 52 discharges liquid and applies the liquid to the sheet P. FIG. 2 is a schematic plan view illustrating an example of the configuration of the head array 50 according to the present embodiment. The head array 50 illustrated in FIG. 2 includes the plurality of liquid discharge heads 52 in a staggered array or a staggered arrangement. The liquid discharge heads 52 are arranged along a sub-scanning direction (the Z axis direction in the drawing) orthogonal to the main scanning direction (the X axis direction in the drawing), in which the conveyor drum 11 rotates. The liquid discharge heads 52 in one row are offset by a half pitch from the liquid discharge heads 52 in a different row. The plurality of liquid discharge heads 52 is arranged in rows along a first direction (the Z axis direction). The liquid discharge heads 52 are arranged such that the adjacent liquid discharge heads 52 overlap partly with each other when viewed in a second direction (the X axis direction) orthogonal to the first direction.

In the example of FIG. 2, five liquid discharge heads 52 are in one row, and six liquid discharge heads 52 are in another row. The number of liquid discharge heads 52 is not limited to the example of FIG. 2, and the number of liquid discharge heads 52 in each row may be five or six or more. Alternatively, each row can include the same number of liquid discharge heads 52. Referring back to FIG. 1, the head cap 70 is a part of a device that performs operation for maintenance of a liquid application surface (nozzle face) and the periphery of the liquid application surface of the liquid discharge head 52. The maintenance is, for example, maintenance, servicing, cleaning, or inspection for preventing or eliminating clogging caused by thickening or adhesion of solidified liquid on the liquid discharge head 52.

As illustrated in FIG. 1, the head cap 70 is disposed between the circumferential surface of the conveyor drum 11 and the corresponding head array 50. The head caps 70 are provided corresponding to the head arrays 50, and the same number of maintenance devices 70 matches the number of head arrays 50. Each of the head caps 70 perform maintenance on the liquid discharge heads 52 of the corresponding head array 50. The head cap 70 includes an opening so as to cover and to be in tight contact with the entire nozzle face of the head array 50.

When the inkjet printer 10 is in operation, that is, when the conveyor drum 11 rotates to convey the sheet P, which is supplied from the sheet feeding tray 12 and is in tight contact with the surface of the conveyor drum 11, or the liquid discharge assembly 30 executes the liquid discharge operation, heat is generated in the components involved in such operations. Such heat is not directly required for the operation of the inkjet printer 10 and is to be exhausted as waste heat. On the other hand, when waste heat is not exhausted, the waste heat may degrade the environment in which the conveyor drum 11 and the liquid discharge assembly 30 operate, which may cause a failure. Therefore, the waste heat needs to be exhausted to the outside of the inkjet printer 10. In the following description, a "heat source 700" collectively refers to a mechanism and a component that generate waste heat as the inkjet printer 10 operates.

Figure 3:
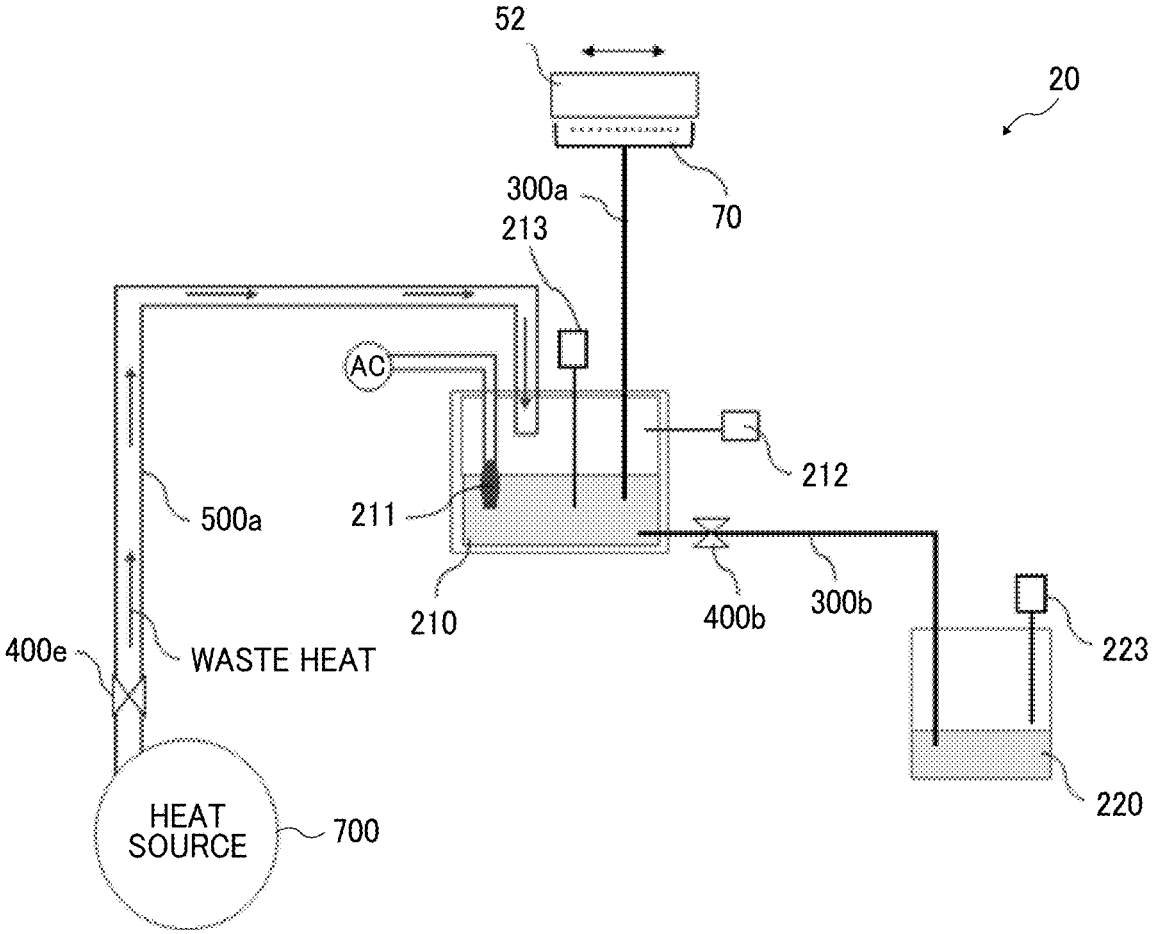
FIG. 3 is a view illustrating a maintenance device of the liquid discharge apparatus illustrated in FIG. 1, according to a first embodiment.

A description is given of a liquid discharge apparatus according to a first embodiment of the present disclosure with reference to FIG. 3. FIG. 3 is a view illustrating a configuration of the maintenance device 20 of the inkjet printer 10.

In FIG. 3, the maintenance device 20 moisturizes the "nip surface" which is the contact area between the head cap 70 and the nozzle face (nozzle plate) of the liquid discharge head 52, and the passage from the head cap 70 to the waste liquid tank 220. The maintenance device 20 further includes a buffer tank 210 for temporarily storing the waste liquid, in order to turn the waste liquid into vapor for moisturizing. The maintenance device 20 further includes a heat introduction passage configured to introduce the exhaust heat from the heat source 700 into the buffer tank 210 and a heater, such as a halogen heater, to heat the waste liquid stored in the buffer tank 210, in order to raise the temperature inside the buffer tank 210. This structure can prevent the liquid adhering to the "nip surface" from being exposed to the air and drying.

The maintenance device 20 includes a heat introduction passage 500*a* (e.g., a tube or a pipe) coupling the heat source 700 with the buffer tank 210, to introduce exhaust heat into the buffer tank 210. A heat exhaust valve 400*e* as a control valve is installed in the middle of the heat introduction passage 500*a*. The maintenance device 20 uses the exhaust heat for generating vapor, to prevent the nip surface from drying.

The amount of exhaust heat from the heat source 700 to the buffer tank 210 is controlled by the heat exhaust valve 400*e*.

The buffer tank 210 serves as a temporary tank to temporarily store the liquid (waste liquid) discharged by purging and collected by the head cap 70, instead of directly sending the collected liquid to the waste liquid tank 220. In the maintenance device 20, the head cap 70 does not directly communicate with the waste liquid tank 220. Instead, the head cap 70 communicates with the waste liquid tank 220 via a cap-tank communication passage 300*a* (e.g., a tube or a pipe) and a waste liquid communication passage 300*b* (e.g., a tube or a pipe). Via the cap-tank communication passage 300*a*, the head cap 70 communicates with the buffer tank 210. Via the waste liquid communication passage 300*b*, the buffer tank 210 communicates with the waste liquid tank 220. The waste liquid tank 220 is disposed below the buffer tank 210 as illustrated in FIG. 3. The waste liquid communication passage 300*b* includes a first waste liquid valve 400*b* as a waste liquid control valve to control the amount of movement of the waste liquid.

In the buffer tank 210, a first heater 211 is installed to heat the temporarily stored waste liquid (a liquid ink). The first heater 211 is disposed near the bottom of the buffer tank 210 and serves as a heat source to directly heat the liquid stored in the buffer tank 210.

Further, the buffer tank 210 includes a temperature and humidity sensor 212 to detect the environmental conditions (temperature and humidity) inside the buffer tank 210 and a liquid level sensor 213 to detect the amount of stored liquid.

The waste liquid tank 220 includes a liquid level sensor 223 to detect the amount of waste liquid stored therein. The waste liquid tank 220 is replaceable and is replaced with an empty waste liquid tank 220 when the stored amount of waste liquid exceeds a threshold.

In the inkjet printer 10 including the maintenance device 20 according to the present embodiment described above, the temperature and the humidity in the buffer tank 210 storing the waste liquid are controlled with the amount of exhaust heat from the heat source 700 and the heating by the first heater 211, to generate vapor. As the energy required to generate the vapor, not only the first heater 211 but also the exhaust heat can be used, so that the energy consumption can be reduced. Then, using such an energy-saving vapor generation structure, the cap-tank communication passage 300*a*, the head cap 70, and the nozzle faces of the liquid discharge heads 52 can be kept moisturized and prevented from drying.

That is, the maintenance device 20 according to the present embodiment is advantageous in reducing the energy for preventing the liquid from drying while effectively preventing the liquid from drying even in a situation where quick-drying liquid is used and the nozzle face and the like dry easily.

Figure 4:
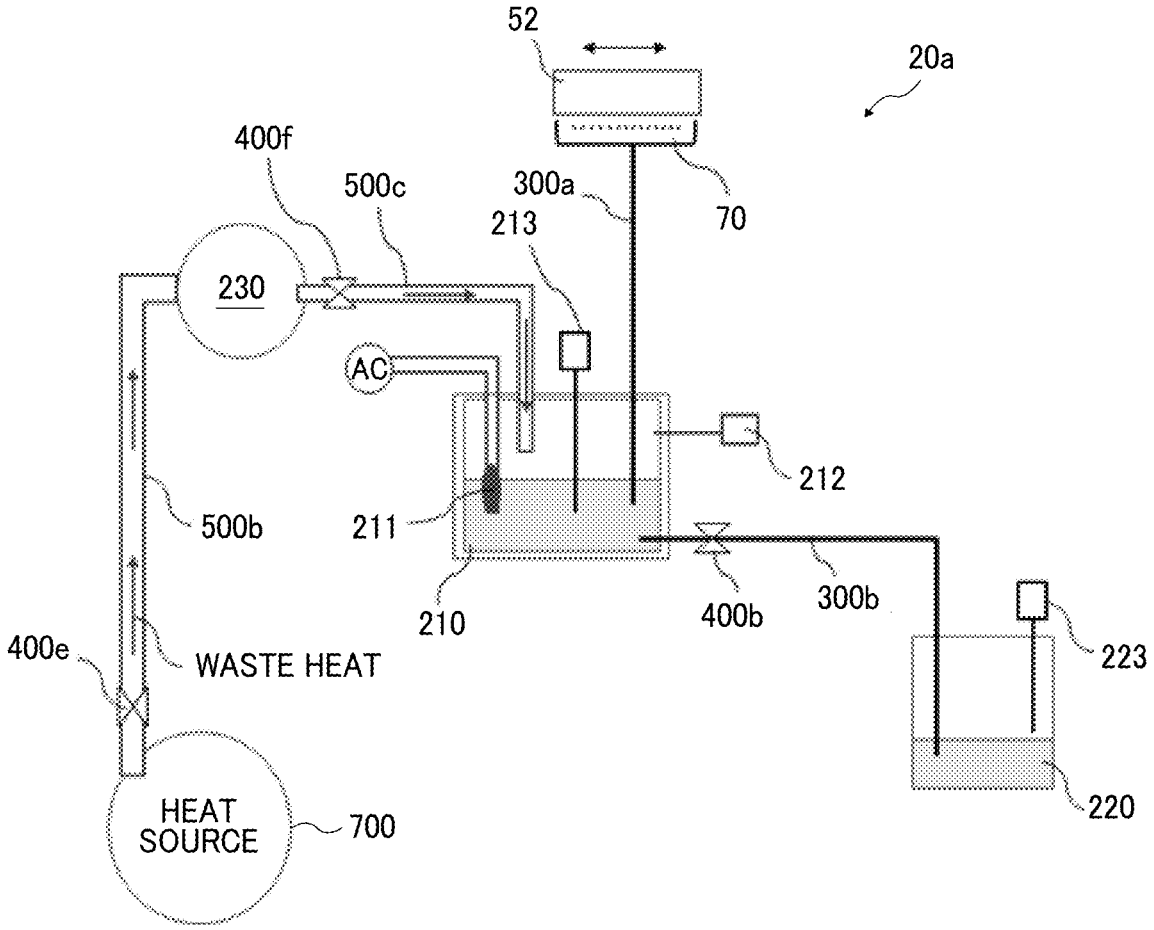
FIG. 4 is a view illustrating a maintenance device according to a second embodiment.

A description is given of a second embodiment of the present disclosure, with reference to FIG. 4.

The inkjet printer 10 according to the second embodiment includes a maintenance device 20*a* illustrated in FIG. 4. The maintenance device 20*a* includes a heat storage device 230 to temporarily store the exhaust heat from the heat source 700. The heat storage device 230 is, for example, a general water heat storage tank or a general ice heat storage tank used for heat pumps and heat storage systems.

In the maintenance device 20*a* according to the second embodiment, the heat introduction passage configured to introduce the exhaust heat from the heat source 700 into the buffer tank 210 includes the heat storage device 230 and partial introduction passages coupled to the heat storage device 230. The maintenance device 20*a* illustrated in FIG. 4 includes, instead of the heat introduction passage 500*a* illustrated in FIG. 3, a first partial heat introduction passage 500*b* through which the heat source 700 communicates with the heat storage device 230, and a second partial heat introduction passage 500*c* through which the heat storage device 230 communicates with the buffer tank 210.

The first partial heat introduction passage 500*b* is provided with the heat exhaust valve 400*e* to control the amount of exhaust heat from the heat source 700. The second partial heat introduction passage 500*c* is provided with a heat exhaust valve 400*f* to control the amount of heat from the heat storage device 230 to the buffer tank 210.

The maintenance device 20*a* according to the present embodiment temporarily stores the exhaust heat from the heat source 700 in the heat storage device 230. This structure is advantageous in that the heat in the heat storage device 230 can be used when inoperable state of the inkjet printer 10 continues due to maintenance or an unexpected malfunction.

That is, when the inkjet printer 10 stops operating and the amount of heat exhausted from the heat source 700 decreases, a controller of the inkjet printer 10 controls temperature and humidity of the buffer tank 210 using the heat from the first heater 211 in the buffer tank 210 and heat from the heat storage device 230. As a result, vapor for moisturizing the head cap 70 and the like is continuously generated. As the energy required to generate the vapor, not only the first heater 211 but also the exhaust heat can be used, so that the energy consumption can be reduced. Then, using such an energy-saving vapor generation structure, the cap-tank communication passage 300*a*, the head cap 70, and the nozzle faces of the liquid discharge heads 52 can be kept moisturized and prevented from drying.

That is, the maintenance device 20*a* according to the present embodiment is advantageous in reducing the energy for preventing the liquid from drying while effectively preventing the liquid from drying even in a situation where quick-drying liquid is used, the standby time of the liquid discharge head 52 is long, and the liquid easily dries.

Figure 5:
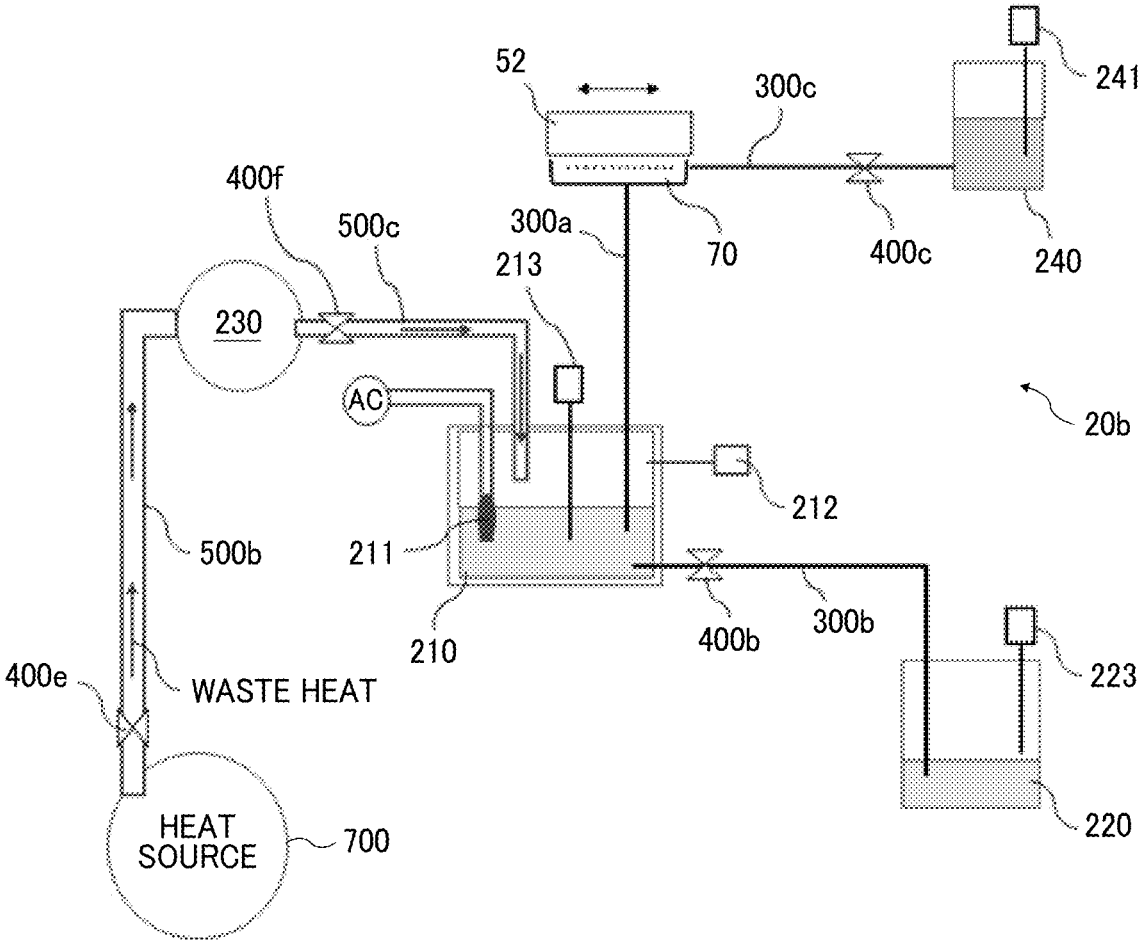
FIG. 5 is a view illustrating a maintenance device according to a third embodiment.

A description is given of a liquid discharge apparatus according to a third embodiment of the present disclosure, with reference to FIG. 5. The inkjet printer 10 according to the third embodiment includes a maintenance device 20*b* illustrated in FIG. 5. The maintenance device 20*b* includes an adjusting liquid tank 240 and an adjusting liquid passage 300*c* (e.g., a tube, a pile, or a pipeline) coupling the adjusting liquid tank 240 with the head cap 70, in addition to the structure illustrated in FIG. 4.

The adjusting liquid tank 240 is provided with a liquid level sensor 241 to detect the liquid level in the adjusting liquid tank 240. Further, the adjusting liquid passage 300*c* coupling the adjusting liquid tank 240 and the head cap 70 includes a liquid valve 400*c* to control the liquid flow rate from the adjusting liquid tank 240 to the head cap 70. The adjusting liquid tank 240 stores an adjusting liquid for adjusting the viscosity of the liquid inside the buffer tank 210.

The amount of and the viscosity of waste liquid stored in the buffer tank 210 change with time. Further, the viscosity increases as the amount of liquid in the buffer tank 210 decreases. As the viscosity of liquid increases, the liquid less easily evaporates. Therefore, when the viscosity of the waste liquid stored in the buffer tank 210 becomes too high, the adjusting liquid (such as water) is introduced from the adjusting liquid tank 240 into the buffer tank 210 via the head cap 70 and the cap-tank communication passage 300*a*, in order to maintain a preferable viscosity, thereby securing the ease of evaporation. Thus, the viscosity of the waste liquid is reduced so that the waste liquid easily evaporates.

That is, the maintenance device 20*b* according to the present embodiment can control the viscosity of the waste liquid stored in the buffer tank 210 in order to maintain the moisture in the vicinity of the nip surface and the head cap 70, and in the cap-tank communication passage 300*a*. This configuration can reduce the energy for preventing the liquid from drying while effectively preventing the liquid from drying even in a situation where the standby time of the liquid discharge head 52 is long and the liquid easily dries.

Figure 6:
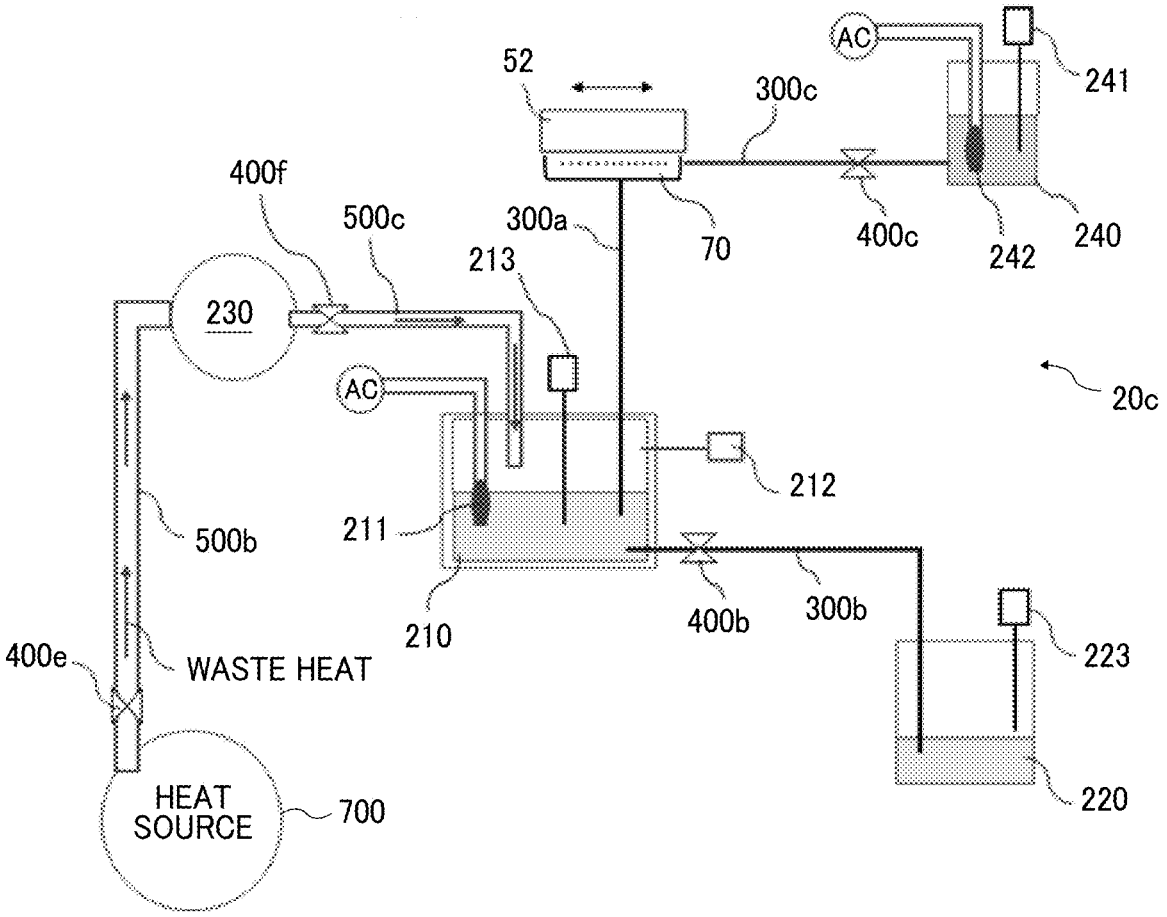
FIG. 6 is a view illustrating a maintenance device according to a fourth embodiment.

A description is given of a fourth embodiment of the present disclosure, with reference to FIG. 6. The inkjet printer 10 according to the fourth embodiment includes a maintenance device 20*c* illustrated in FIG. 6. The maintenance device 20*c* further includes, in addition to the structure illustrated in FIG. 5, a second heater 242 (an adjusting liquid heater) to heat the adjusting liquid tank 240.

The second heater 242 heats the adjusting liquid stored in the adjusting liquid tank 240. The second heater 242 can control the temperature of the adjusting liquid supplied from the adjusting liquid tank 240 to the head cap 70 via the adjusting liquid passage 300*c*.

As described above in the third embodiment, the amount of and the viscosity of waste liquid stored in the buffer tank 210 change with time. Further, the viscosity increases as the amount of liquid in the buffer tank 210 decreases. As the viscosity of liquid increases, the liquid less easily evaporates. Therefore, when the viscosity of the waste liquid stored in the buffer tank 210 becomes too high, the temperature-controlled adjusting liquid (such as warm water) is introduced from the adjusting liquid tank 240 into the buffer tank 210 via the head cap 70 and the cap-tank communication passage 300*a*, in order to maintain a preferable viscosity, thereby securing the ease of evaporation. Thus, a preferable viscosity of the waste liquid is maintained so that the waste liquid can easily evaporate.

That is, the maintenance device 20*c* according to the present embodiment can control the viscosity of the waste liquid stored in the buffer tank 210 and improve ease of evaporation in order to maintain the moisture in the vicinity of the nip surface and the head cap 70, and in the cap-tank communication passage 300*a*. This configuration can reduce the energy for preventing the liquid from drying while effectively preventing the liquid from drying even in a situation where the standby time of the liquid discharge head 52 is long and the liquid easily dries.

Figure 7:
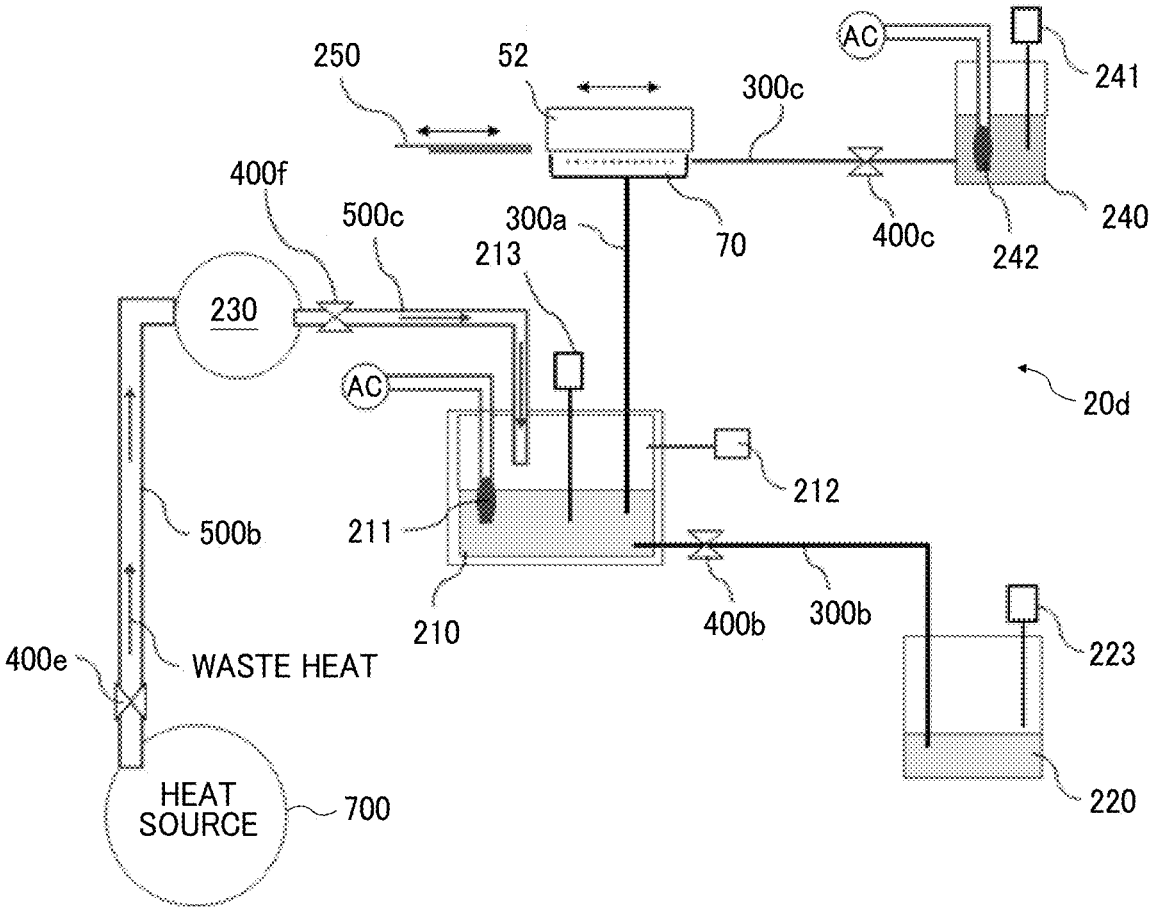
FIG. 7 is a view illustrating a maintenance device according to a fifth embodiment.

A description is given of a fifth embodiment of the present disclosure, with reference to FIG. 7. The inkjet printer 10 according to the fifth embodiment includes a maintenance device 20*d* illustrated in FIG. 7. The maintenance device 20*d* includes a shutter 250 (or a cover) to open and close the opening of the head cap 70 when the head cap 70 is separate from the liquid discharge head 52. This structure can retain moisture in the head cap 70 separated from the liquid discharge head 52 and in the cap-tank communication passage 300*a*.

The shutter 250 opens and closes the opening of the head cap 70 on the upper side in FIG. 7. The shutter 250 can prevent drying inside the head cap 70 separated from the liquid discharge head 52 when the liquid discharge head 52 does not perform liquid discharge (for maintenance of the liquid discharge head 52 or cleaning of the nozzle face). That is, when the head cap 70 is separated from the liquid discharge head 52, the head cap 70 is open, and the shutter 250 can close the head cap 70.

That is, the maintenance device 20*e* can effectively prevent drying of the head cap 70 separated from the liquid discharge head 52.

Figure 8:
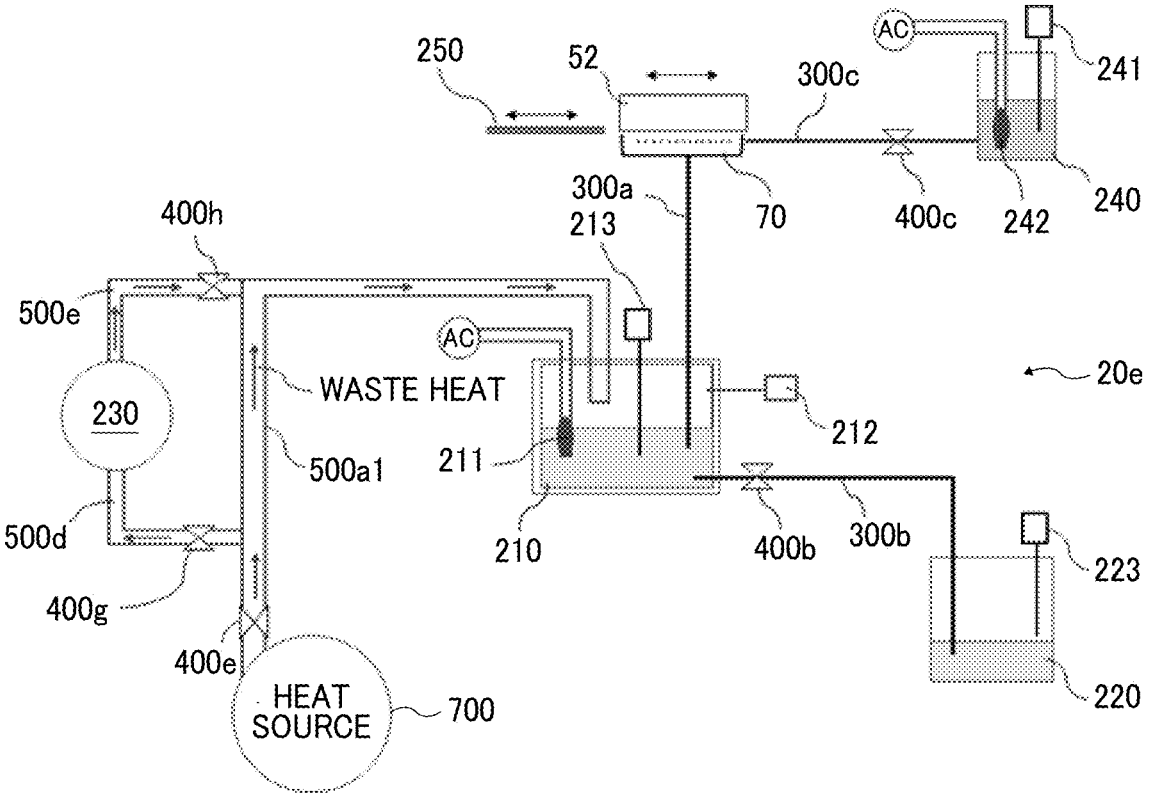
FIG. 8 is a view illustrating a maintenance device according to a sixth embodiment.

A description is given of a sixth embodiment of the present disclosure, with reference to FIG. 8. The maintenance device 20*e* illustrated in FIG. 8 is configured to finely control heating of the buffer tank 210, to better save the energy for preventing drying of the nip surface and the like. Specifically, in the maintenance device 20*e*, the heat introduction passage to the heat storage device 230 is branched.

The maintenance device 20*e* includes a second branch passage 500*d* as a bypass passage branching from a first branch passage 500*a*1 (the heat introduction passage) that couples the heat source 700 and the buffer tank 210. A portion of the exhaust heat from the heat source 700 is introduced into the second branch passage 500*d*. The first branch passage 500*a*1 is provided with the heat exhaust valve 400*e* (a first valve). The second branch passage 500*d* includes a heat exhaust valve 400*g* (a second valve) to control the air volume from the heat source 700.

The bypass passage further includes the heat storage device 230 and a third branch passage 500*e* that extends from the heat storage device 230 and converges into the first branch passage 500*a*1 (the heat introduction passage). The third branch passage 500*e* includes a heat exhaust valve 400*h* (a third valve) that controls the amount of air from the heat storage device 230.

The exhaust heat from the heat storage device 230 can be sent through the bypass passage. With the heat exhaust valves 400*e*, 400*g*, and 400*h*, the mode of introducing the exhaust heat into the buffer tank 210 can be selectively switched among different modes of introducing heat from only the heat source 700, introducing heat from only the heat storage device 230, introducing heat from both the heat source 700 and the heat storage device 230. This structure is advantageous in that the heating in the buffer tank 210 can be finely controlled, and, the buffer tank 210 can be heated with the heat storage device 230 even when the power of the inkjet printer 10 is turned off for some reason.

The maintenance device 20*e* according to the present embodiment temporarily stores the exhaust heat from the heat source 700 in the heat storage device 230. This structure is advantageous in that the heat in the heat storage device 230 can be used when inoperable state of the inkjet printer 10 continues due to maintenance or an unexpected malfunction.

That is, when the inkjet printer 10 stops operating and the amount of heat exhausted from the heat source 700 decreases, a controller of the inkjet printer 10 controls temperature and humidity of the buffer tank 210 using the heat from the first heater 211 in the buffer tank 210 and heat from the heat storage device 230. Further, even when the inkjet printer 10 is in operation, use of the heat from both the heat source 700 and the heat storage device 230 to control the temperature and the humidity of the buffer tank 210 is advantageous in further saving the energy consumption and continuously generating the vapor for moisturizing the head cap 70 and the like.

Further, according to the maintenance device 20*e*, the mode of supply of heat can be finely selected, and the inside of the buffer tank 210 can be heated by the heat from the heat storage device 230 even when the heat source 700 stops operating. Therefore, the maintenance device 20*e* can reliably keep the head cap 70 and the like moisturized.

Figure 9:
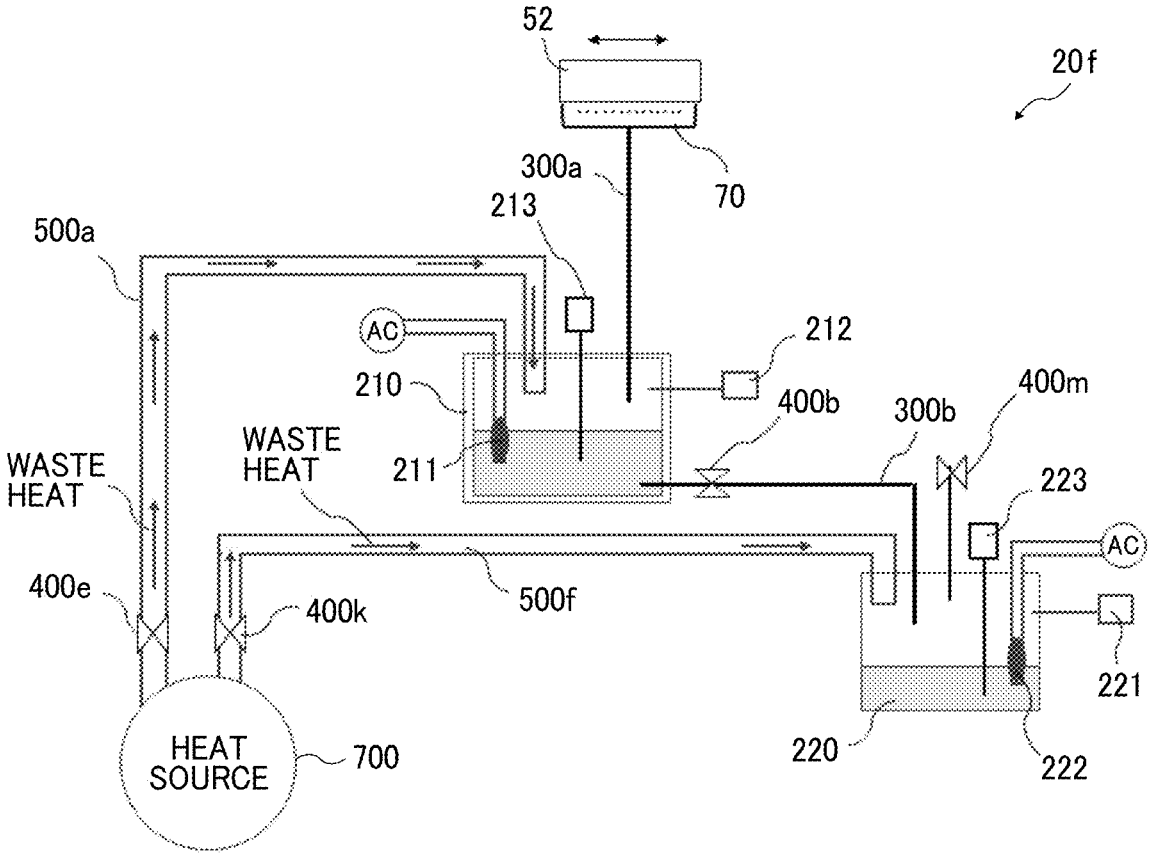
FIG. 9 is a view illustrating a maintenance device according to a seventh embodiment.

A description is given of a seventh embodiment of the present disclosure, with reference to FIG. 9. The maintenance device 20*f* illustrated in FIG. 9 includes, in addition to the heat introduction passage 500*a* as a first heat introduction passage, a heat introduction passage 500*f* as a second heat introduction passage and a waste liquid heater 222 in order to moisturize the passage communicating the buffer tank 210 with the waste liquid tank 220.

The heat introduction passage 500*f* is configured to introduce the exhaust heat from the heat source 700 into the waste liquid tank 220. The heat introduction passage 500*f* includes a heat exhaust valve 400*k* to control the amount of exhaust heat introduced into the waste liquid tank 220.

The waste liquid tank 220 includes the waste liquid heater 222 as the third heater to heat the waste liquid in the waste liquid tank 220. The waste liquid tank 220 further includes a temperature and humidity sensor 221 to detect the environmental conditions (temperature and humidity) in the waste liquid tank 220, and the liquid level sensor 223 to detect the amount of waste liquid in the waste liquid tank 220. The waste liquid tank 220 further includes an air valve 400*m* that controls communication with external air.

With the above configuration, the maintenance device 20*f* can control the amount of exhaust heat from the heat source 700 and the heating by the waste liquid heater 222 to control the temperature and the humidity inside the waste liquid tank 220. This structure can moisturize the waste liquid communication passage 300*b* and control the amount of liquid in the waste liquid tank 220, thereby reducing the occurrence rate of passage blockage in the waste liquid communication passage 300*b* that couples the buffer tank 210 with the waste liquid tank 220. This structure also facilitates control of the amount of waste liquid in the waste liquid tank 220.

The present disclosure is not limited to specific embodiments described above, and numerous additional modifications and variations are possible in light of the teachings within the technical scope of the appended claims. It is therefore to be understood that, the disclosure of the present specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The invention claimed is:

1. A liquid discharge apparatus comprising:

a liquid discharge head including a nozzle face including a nozzle configured to discharge a liquid;

a head cap configured to cover the nozzle face of the liquid discharge head;

a buffer tank disposed downstream from the head cap in a direction of collection of the liquid from the liquid discharge head and configured to temporarily store the liquid;

a communication passage coupling the head cap and the buffer tank;

a heater configured to heat the liquid stored in the buffer tank;

a heat source configured to generate heat; and a heat introduction passage coupling the heat source with the buffer tank, to introduce exhaust heat from the heat source into the buffer tank.

2. The liquid discharge apparatus according to claim 1, wherein the heat introduction passage includes a control valve configured to control an amount of the exhaust heat sent to the buffer tank.

3. The liquid discharge apparatus according to claim 1, further comprising a heat storage device configured to temporarily store the exhaust heat, wherein the heat introduction passage includes:

a first partial passage coupling the heat source with the heat storage device; and a second partial passage coupling the heat storage device with the buffer tank.

4. The liquid discharge apparatus according to claim 3, wherein the heat introduction passage includes:

a first branch passage coupling the heat source with the buffer tank, the first branch passage including a first valve configured to control the amount of the exhaust heat from the heat source to the buffer tank;

a second branch passage coupling the heat source with the heat storage device, the second branch passage including a second valve configured to control the amount of the exhaust heat from the heat source to the heat storage device; and a third branch passage coupling the heat storage device with the first branch passage, the third branch passage including a third valve configured to control the amount of the exhaust heat from the heat storage device to the first branch passage.

5. The liquid discharge apparatus according to claim 1, further comprising:

a liquid level sensor configured to detect a liquid level in the buffer tank; and a temperature and humidity sensor configured to detect temperature and humidity inside the buffer tank.

6. The liquid discharge apparatus according to claim 1, further comprising:

an adjusting liquid tank configured to store an adjusting liquid for adjusting an amount and a viscosity of the liquid stored in the buffer tank; and an adjusting liquid passage coupling the adjusting liquid tank and the head cap.

7. The liquid discharge apparatus according to claim 6, wherein the adjusting liquid tank includes an adjusting liquid heater configured to heat the adjusting liquid.

8. The liquid discharge apparatus according to claim 1, further comprising a shutter configured to open and close the head cap.

9. The liquid discharge apparatus according to claim 1, wherein the heat introduction passage is referred to as a first heat introduction passage, and the liquid discharge apparatus further comprises:

a waste liquid tank disposed below the buffer tank and configured to store the liquid discharged from the buffer tank;

a waste liquid level sensor configured to detect a liquid level in the waste liquid tank;

a waste liquid passage coupling the buffer tank and the waste liquid tank, the waste liquid passage including a waste liquid control valve configured to control a flow rate in the waste liquid passage; and a second heat introduction passage coupling the heat source into the waste liquid tank, to introduce the exhaust heat from the heat source into the waste liquid tank.

10. The liquid discharge apparatus according to claim 9, further comprising a waste liquid heater configured to heat the liquid stored in the waste liquid tank.

* * * * *